US007189107B1

(12) United States Patent
Strayer et al.

(10) Patent No.: US 7,189,107 B1
(45) Date of Patent: Mar. 13, 2007

(54) POWER MODULE HAVING RETRACTABLE CORD

(75) Inventors: Mark Strayer, Lamar, MO (US); Michael L. Franks, Neosho, MO (US)

(73) Assignee: O Sullivan Industries Inc, Lamar, MO (US)

( * ) Notice: Subject to any disclaimer, the term of this patent is extended or adjusted under 35 U.S.C. 154(b) by 0 days.

(21) Appl. No.: 11/234,567

(22) Filed: Sep. 23, 2005

Related U.S. Application Data

(60) Provisional application No. 60/612,011, filed on Sep. 22, 2004.

(51) Int. Cl.
*H01R 13/70* (2006.01)

(52) U.S. Cl. ..... 439/501

(58) Field of Classification Search ..... 439/650, 439/651, 652, 214, 501; 108/50.02; 191/12.2 R, 191/12.4
See application file for complete search history.

(56) References Cited

U.S. PATENT DOCUMENTS

| | | | | |
|---|---|---|---|---|
| 3,821,496 | A * | 6/1974 | Malone | 191/12.2 R |
| 4,500,150 | A * | 2/1985 | Leibensperger et al. | 439/502 |
| 4,685,634 | A * | 8/1987 | Schwartz | 242/405.3 |
| 4,792,881 | A * | 12/1988 | Wilson et al. | 361/827 |
| 4,875,878 | A * | 10/1989 | Meyer | 439/501 |
| 5,372,225 | A * | 12/1994 | Joynes et al. | 191/12.2 R |
| 5,913,487 | A * | 6/1999 | Leatherman | 242/378.4 |
| 6,591,952 | B1 * | 7/2003 | Randall | 191/12.4 |
| 6,666,712 | B1 * | 12/2003 | Kramer | 439/501 |

* cited by examiner

*Primary Examiner*—Phuong Dinh
(74) *Attorney, Agent, or Firm*—Haynes and Boone LLP; Dave R. Hofman

(57) ABSTRACT

A power module including a housing, a plurality of first electrical connectors coupled to the housing, a second electrical connector coupled to an end of an extension cord that is configured to extend from and retract back into the housing, and a power cord coupled to the housing and configured to energize the second electrical connector via the extension cord and each of the plurality of first electrical connectors.

20 Claims, 4 Drawing Sheets

POWER MODULE HAVING RETRACTABLE CORD

RELATED APPLICATION

This application claims the benefit of the earlier filing date of commonly-assigned U.S. Provisional Patent Application No. 60/612,011, entitled "RETRACTABLE POWER STRIP/MODULE/HUB," filed Sep. 22, 2004, the entirety of which is hereby incorporated by reference herein.

BACKGROUND

Extension cords, including heavy duty, outdoor, and/or all-weather cords, can be overly bulky, cumbersome, or otherwise difficult to handle. They are also prone to entanglement, whether individually or with nearby tools, furniture, and other items. They also present storage problems, often requiring additional labor and physical exertion to coil or otherwise arrange into a storable configuration, and such storage configuration often makes removal for subsequent tasks additionally difficult.

BRIEF DESCRIPTION OF THE DRAWINGS

Aspects of the present disclosure are best understood from the following detailed description when read with the accompanying figures. It is emphasized that, in accordance with the standard practice in the industry, various features may not be drawn to scale. In fact, the dimensions of the various features may be arbitrarily increased or reduced for clarity of discussion.

DETAILED DESCRIPTION

Figure 1:
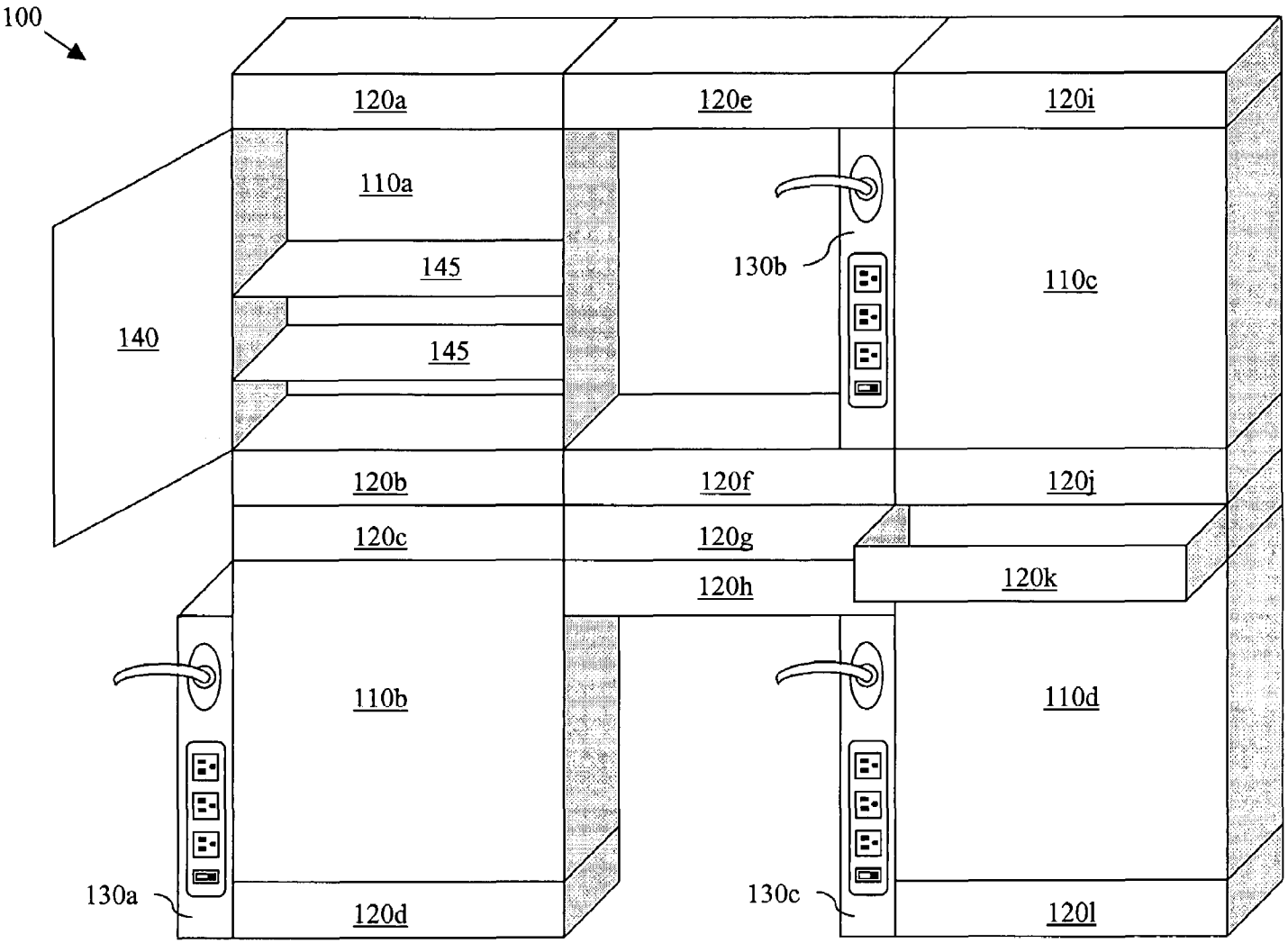
FIG. 1 is a perspective view of at least a portion of one embodiment of apparatus according to aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIGS. 1–4 demonstrate aspects of various embodiments of a power module having a retractable cord according to aspects of the present disclosure, as well as aspects of various embodiments of storage means, furniture pieces, cabinetry, tool boxes, chests, workbenches, and other embodiments, applications, and implementations (hereafter collectively referred to as a furniture piece or furniture pieces) which may include one or more embodiments of the power module according to aspects of the present disclosure. A single instance, component or other unit of a furniture piece may include one or more instances of the power module according to aspects of the present disclosure. In these and other implementations, each power module may be configured to be retrofitted to an existing furniture piece, while other implementations may embody a furniture piece that is marketed with one or more power modules in an assembled or pre-assembled state, possibly requiring some assembly by an end user and/or retailer.

One or more power modules according to aspects of the present disclosure, and/or a component or other portion thereof, may be fixedly, permanently, temporarily, detachably or otherwise mounted or coupled to an internal and/or external surface, edge, bracket, structure or other portion of a furniture piece. Various embodiments of the power module according to aspects of the present disclosure, and/or a component or other portion thereof, may also be employed alone, such as an "on-the-go" or otherwise portable apparatus.

The retractable cord which may be included in some embodiments of power module according to aspects of the present disclosure may be retractable by user-operation/manipulation, and/or by operation of a biasable member or other stored energy means, such as a torsion spring, motor, etc. The extendable/retractable end of such cord may include one or more male and/or female electrical connectors, which may be standard connectors, such as may be employed with a 120V electrical network, a 220V electrical network, and/or other electrical networks. The extendable/retractable end of such cord may also or alternatively provide electrical power to, receive electrical power from, or otherwise be directly or indirectly electrically connected to one or more other electrical connectors secured to or otherwise coupled to a housing, bracketry, and/or other structure directly or indirectly coupled to and/or associated with the retractable cord or its assembly.

The power module may include one or more surge protectors and/or surge protection circuits or circuitry, such as may be employed to prevent damage to electrically-powered tools or other items electrically coupled thereto. The power module may also or alternatively include one or more switches and/or switching circuits or circuitry, such as may be employed to select which of the electrical connectors therein are electrically "on" or "off." The power module may also or alternatively include an engaging mechanism, device, and/or structure which may be configured to at least temporarily prevent retraction of the cord, and/or a stop mechanism, device, and/or structure which may be configured to at least temporarily prevent over-extension of the cord, and/or a mechanism, device, and/or stop which may be configured to provide strain relief for one or more portions or lengths of the cord.

Referring to FIG. 1, illustrated is a perspective view of at least a portion of one embodiment of a furniture piece 100 according to aspects of the present disclosure. The furniture piece 100 includes first utility means 110*a*–*d*, second utility means 120*a*–*l*, and third utility means 130*a*–*c*. However, the embodiment shown in FIG. 1 is provided merely as an example, and other embodiments within the scope of the present disclosure may include other numbers of any of the first, second and third utility means, including embodiments having none of the first utility means, none of the second utility means, or none of the third utility means, as well as embodiments having utility means other than as depicted in FIG. 1.

First utility means 110*a–d* may be cabinet storage means, such as may have a door 140 which may be opened to reveal a number of drawers, shelves or other storage organizers 145. Second utility means 120*a–l* may be single drawer storage means, such as may be slidably engaged with other structure of the apparatus 100 for sliding out (e.g., drawer 120*k* in FIG. 1) to access contents therein. Third utility means 130*a–c* may be a power module as described elsewhere herein, which may be detachably or permanently coupled to other structure of the apparatus 100. However, embodiments of power modules within the scope of the present disclosure may also be configured for installation within one of the first utility means 110*a–d* and/or one of the second utility means 120*a–l*, and/or to replace one or more of the second utility means 120*a–l*.

Figure 2:
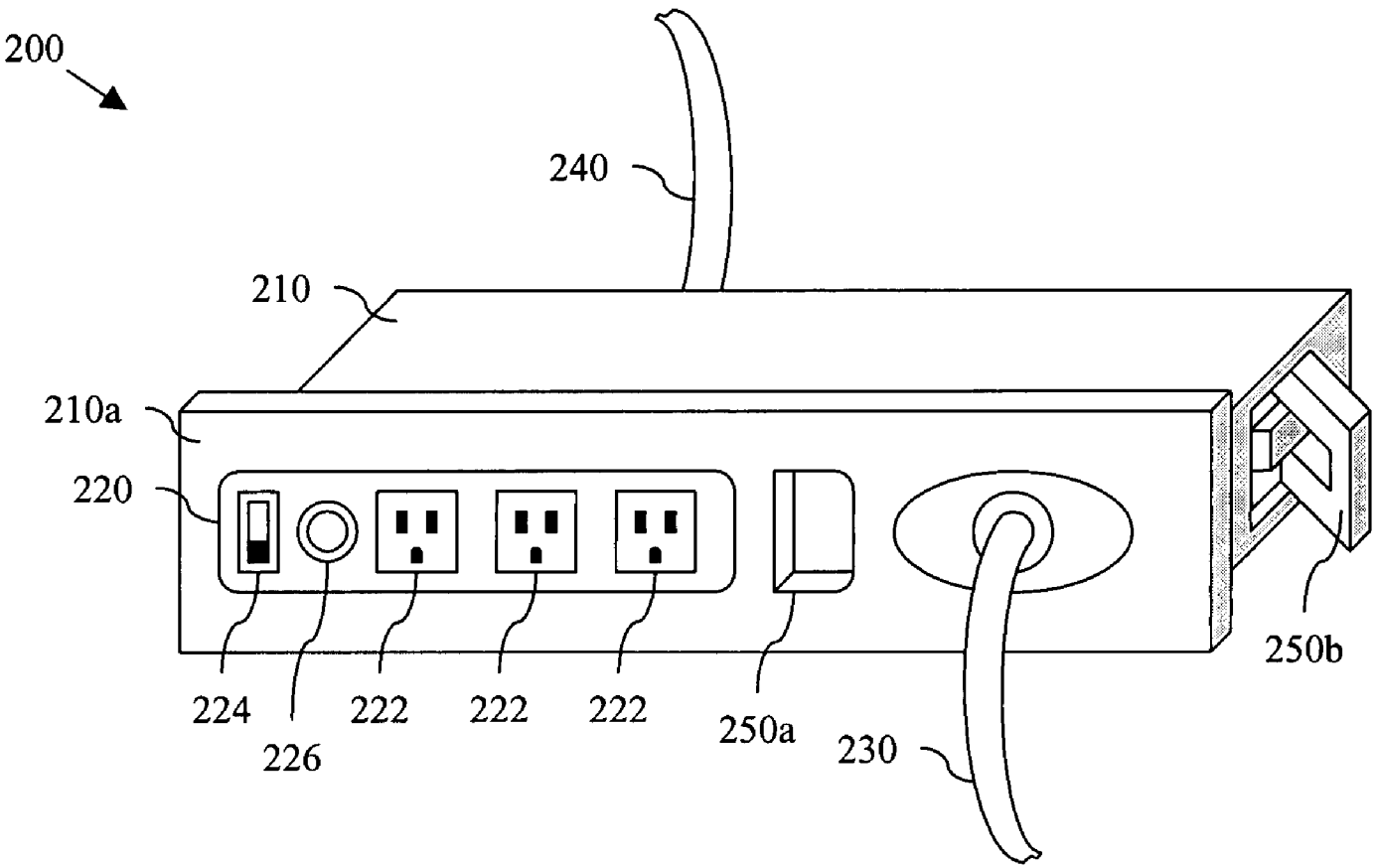
FIG. 2 is a perspective view of at least a portion of one embodiment of apparatus according to aspects of the present disclosure.

Referring to FIG. 2, illustrated is a perspective view of at least a portion of one embodiment of a power module 200 according to aspects of the present disclosure. The power module 200 includes a housing 210, a power strip 220, and a retractable extension cord 230.

The housing 210 may comprise metallic, plastic, fiberglass, composite, and/or other materials, which may be formed into the shape of the housing 210 by machining, welding, bending, press-forming, and/or other manufacturing processes. The housing 210 may have a substantially rectangular shape, as in the embodiment of FIG. 2, although other shapes are also within the scope of the present disclosure. The housing 210 may also include means for electrical grounding, such as a metallic portion of the housing which is configured to contact a ground path when installed in a furniture piece (e.g., the furniture piece 100 shown in FIG. 1). Moreover, in one embodiment, the housing 210 (or the entire module 200) may be sized to fit into an industry-standard or company-standard furniture piece.

The power strip 220 is coupled to, integral to, or otherwise located on the front surface 210*a* of the housing 210. The power strip 220 may substantially resemble a conventional power strip, having several electrical outlets 222 and, possibly, an on/off switch 224 and/or surge protection (possibly with a surge protection indicator 226, such as an LED). The electrical outlets 222 may be configured to receive 2-prong or 3-prong electrical connectors, and may be configured for use with the United States power grid, and/or other countries. For example, the electrical outlets 222 may each be grounded and/or surge-protected, UL-listed power outlets (UL=Underwriters Laboratories, Inc.).

The on/off switch 224 may be configured to energize one or more of the electrical outlets 222 and/or the retractable extension cord 230. Alternatively, the power module 200 may include multiple on/off switches 224 corresponding to different ones of the electrical outlets 222 and the retractable extension cord 230. For example, a first on/off switch may energize the electrical outlets 222 and a second on/off switch may energize the retractable extension cord 230.

The power module 200 also includes a main power cord 240 extending from the rear surface 210*b* of the housing 210, although the main power cord 240 may alternatively extend from the front surface 210*a* or another surface of the housing 210. The main power cord 240 is configured for connection with a 110-V or 220-V or other electrical receptacle, for supplying power to the electrical outlets 222 and the retractable extension cord 230, depending on the status of the one or more on/off switches 224. The main power cord 240 may also be retractable, whether as an alternative or in addition to the extension cord 230 being retractable.

The power module 200 may also include one or more handles facilitating portability of the module 200. For example, one such handle 250*a* may substantially comprising an aperture on the front surface 210*a* or other surface of the housing 210. Another exemplary handle is 250*b*, which may pivot away from a side or other surface of the housing 210 when transporting the power module 200, and which may fold back flush with the surface of the housing 210 to allow re-installation of the module 200 into a furniture piece.

Figure 3:
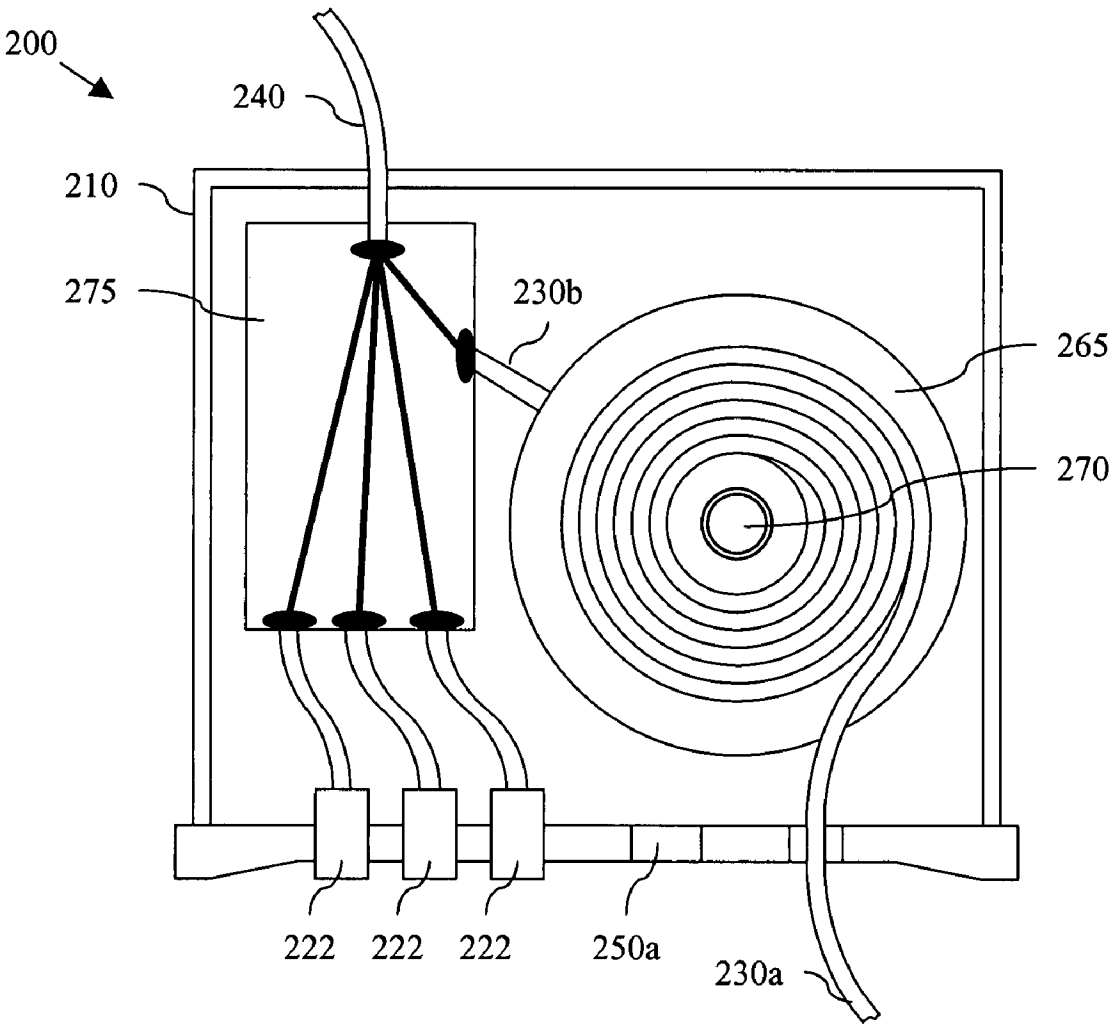
FIG. 3 is a sectional view of at least a portion of one embodiment of apparatus according to aspects of the present disclosure.

Referring to FIG. 3, illustrated is a sectional view of the apparatus 200 shown in FIG. 2. The apparatus 200 includes a reel 265 about which the retractable extension cord 230 is wound. The reel 265 is rotatable around a pivot 270 which is secured to the housing 210. While one end 230*a* of the cord 230 extends from the housing 210 through an opening 210*c* after wrapping around the reel 265, the other end 230*b* of the cord 230 extends internally within the housing 210 to a connection means 275, or is connected to the connection means 275 by an additional conductive member.

The extension cord 230 may be retracted by hand-manipulation by a user. For example, a hand-crank may be mounted external to the housing 210 and extend into the housing for engaging with the reel 265, whereby winding the hand-crank retracts the extension cord 230 into the housing 210 around the reel 265. Alternatively, the extension cord 230 may be self-retracting. For example, a torsion spring or other type of spring may bias the reel 265 in a direction encouraging the extension cord 230 to retract into the housing and, thus, wind around the reel 265. In such embodiments, a stop mechanism may also be employed to prevented unwanted retraction of the extension cord 230. For example, the retraction mechanism may be operable to initially allow the extension cord 230 to be extended from the housing until the end of the cord 230 is extended a desired distance from the housing. Thereafter, releasing the cord 230 may trigger the stop mechanism to prevent the cord 230 from self-retracting into the housing 210. Once use of the cord 230 in this extended state is complete, a slight tug on the cord 230 may release the stop mechanism, allowing the cord 230 to once again self-retract into the housing 210. The cord 230 may be an insulated cord, having one, two, three, or more conductive members, each possibly being a solid or twisted wire insulated from the others, as well as an outer insulating sleeve surrounding all of the conductive members of the cord 230.

The connection means 275 is configured to split electrical energy provided by the main power cord 240 to each of the electrical outlets 222 and the retractable cord 230. For example, the connection means 275 may simply comprise the electrical connection means necessary to connect the electrical outlets 222 and the retractable cord 230 in parallel to the main power cord 240, or may additionally include more extensive circuitry. The connection means 275 may also be configured to electrically couple the main power cord 240 to the electrical outlets 222 and the retractable cord 230 via operation of one or more on/off switches, as described above. The main power cord 240, electrical outlets 222, and retractable cord 230, or conductive members extending therefrom, may be coupled to the connection means 275 by soldering, crimping, electrical connectors, and/or other means.

Figure 4:
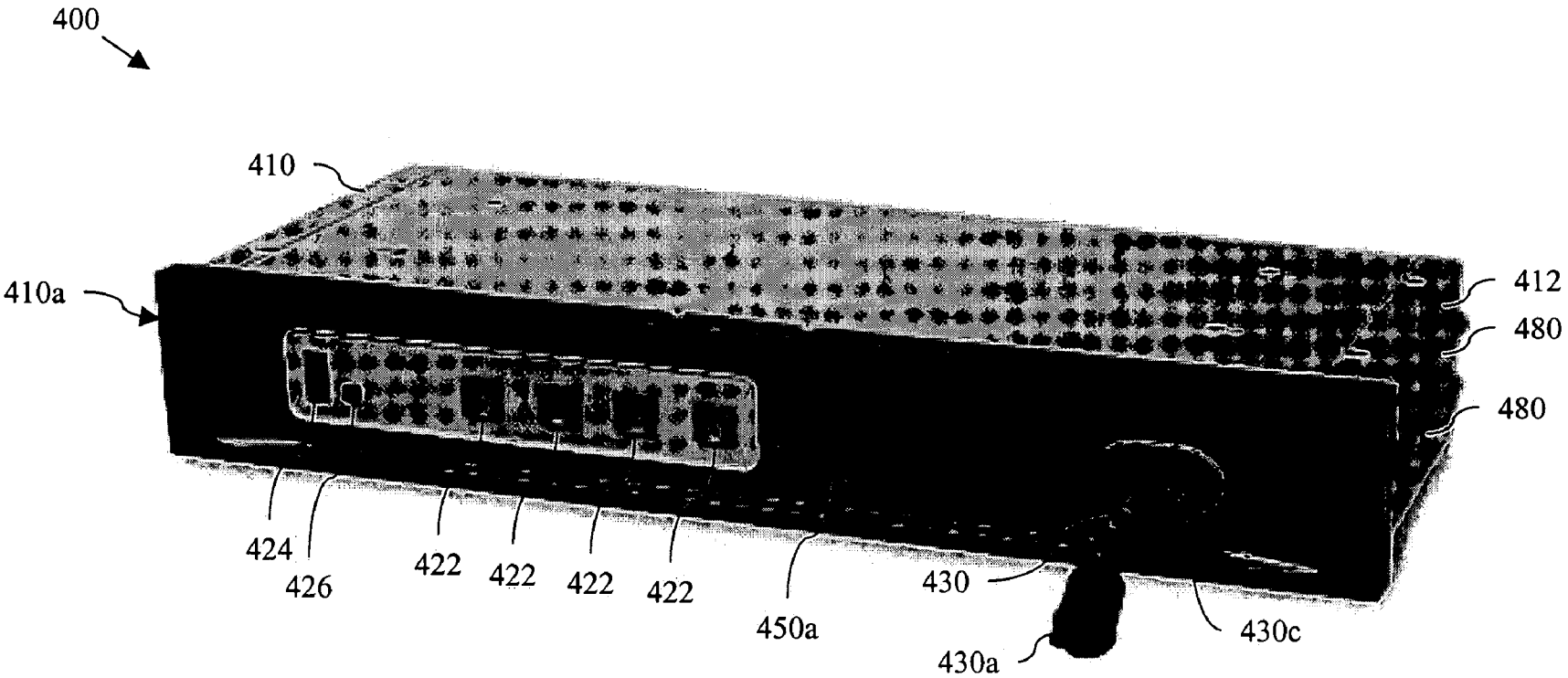
FIG. 4 is a perspective view of at least a portion of one embodiment of apparatus according to aspects of the present disclosure.

Referring to FIG. 4, illustrated is a perspective view of another embodiment of the power module 200 shown in FIGS. 2 and 3, designated herein by the reference numeral 400. The power module 400 may be substantially similar to the power module 200 shown in FIGS. 2 and 3. However, an aspect of the apparatus 400 not depicted in the embodiment shown in FIGS. 2 and 3 is the keyed profile of the outer surfaces 410*a* of the housing 410. That is, one or more of the outer surfaces 412 of the housing 410 may include one or more ridges, slots, grooves, bosses, or other elongated projections or recesses 480 configured to cooperate with corresponding features of structure of a furniture piece into which the power module 400 is configured to be installed.

The embodiment illustrated in FIG. 4 also illustrates the possibly concave nature of the front surface 410*a* of the housing 410. In some implementations, the concave profile of the front surface 410*a* can allow the electrical receptacles 422, switch 424, LED indicator 426, handle 450*a*, and/or other features located on the front surface 410*a* to be recessed. As also shown in FIG. 4, the outer perimeter of the front surface 410*a* (or the front panel of the housing 410) can be slightly or substantially larger than the outer profile of the remainder of the housing 410, such that the front surface or panel 410*a* of the housing 410 can serve as a stop or flange when installing the power module 400 into a furniture piece.

FIG. 4 also depicts the inclusion of a stop 430*c* coupled proximate the end 430*a* of the retractable extension cord 430. The stop 430*c* may be utilized to limit the extent to which the cord 430 can be retracted into the housing 410, possibly providing strain relief for the end 430*c* of the cord 430.

In view of the above, it should be clear that the present disclosure introduces a power module including, at least in one embodiment, a housing, a plurality of first electrical connectors coupled to the housing, and a second electrical connector coupled to an end of an extension cord. The extension cord is configured to extend from and retract back into the housing. A power cord coupled to the housing is configured to energize the second electrical connector, via the extension cord, and each of the plurality of first electrical connectors.

The present disclosure also introduces a power module including a housing, a plurality of first electrical connectors coupled to the housing, and an extension cord stored internal to the housing and configured to be retractably extended from the housing to a variable length. A second electrical connector is coupled to an external end of the extension cord. A power cord is coupled to the housing and is configured to energize the second electrical connector, via the extension cord, and each of the plurality of first electrical connectors.

Another embodiment of a power module according to aspects of the present disclosure includes a housing, a plurality of first electrical connectors coupled to the housing, and an extension cord stored internal to the housing. The extension cord is configured to extend from the housing to a variable length, and also to self-retract into the housing. A second electrical connector is coupled to an external end of the extension cord, and a power cord coupled to the housing is configured to energize the second electrical connector, via the extension cord, and each of the plurality of first electrical connectors.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A power module, comprising:

a housing having an external surface and a keyed, external profile, wherein the keyed, external profile is configured to cooperate with a corresponding profile of a furniture piece into which the power module is configured to be inserted;

a plurality of first female electrical connectors each fixed to the external surface of the housing;

a second female electrical connector coupled to an end of an extension cord extendable from the housing; and a power cord coupled to the housing and configured to energize the second female electrical connector, via the extension cord, and each of the plurality of first female electrical connectors.

2. The power module of claim 1 wherein the extension cord is configured to be stored internal to the housing and be extended from the housing to a variable length during use.

3. The power module of claim 2 wherein the extension cord is configured to be retracted into the housing by hand manipulation.

4. The power module of claim 2 wherein the extension cord is configured to self-retract into the housing when extended from the housing.

5. The power module of claim 1 wherein the keyed, external profile includes elongated projections configured to cooperate with corresponding recesses of the furniture piece profile.

6. The power module of claim 5 wherein the furniture piece is selected from the group consisting of:

storage means;

cabinetry;

a tool box;

a chest;

a furniture piece; and a workbench.

7. The power module of claim 1 wherein each of the plurality of first female electrical connectors is grounded.

8. The power module of claim 1 wherein each of the plurality of first female electrical connectors is surge-protected.

9. The power module of claim 1 wherein each of the plurality of first female electrical connectors is a UL-listed connector.

10. The power module of claim 1 further comprising a switch configured to energize each of the plurality of first female electrical connectors with electricity received from the power cord.

11. The power module of claim 10 wherein the switch is further configured to energize the second female electrical connector via the extension cord.

12. The power module of claim 1 wherein the keyed, external profile includes elongated recesses configured to cooperate with corresponding features of the furniture piece profile.

13. A power module, comprising:

a housing having an external front surface and an external side surface, wherein the external side surface includes a first feature;

a plurality of first female electrical connectors coupled to the external front surface of the housing;

an extension cord stored internal to the housing and configured to be retractably extended from the housing to a variable length;

a second female electrical connector coupled to an external end of the extension cord; and a power cord coupled to and extending from the housing and configured to energize the second female electrical connector, via the extension cord, and each of the plurality of first female electrical connectors;

wherein the first feature is configured to cooperate with a second feature of a corresponding profile of a furniture piece into which the power module is configured to be inserted; and wherein the power module is configured to be received into the furniture piece profile only when the power module is oriented relative to the furniture piece profile in a manner that the first and second features engage.

14. The power module of claim 13 wherein the extension cord is configured to be retracted into the housing by hand manipulation.

15. The power module of claim 13 wherein the extension cord is configured to self-retract into the housing when extended from the housing.

16. The power module of claim 13 wherein each of the first and second features is selected from the group consisting of:

a ridge;

a slot;

a groove;

a boss;

an elongated projection; and an elongated recess.

17. The power module of claim 13 wherein each of the plurality of first female electrical connectors is a grounded, surge-protected, UL-listed connector.

18. The power module of claim 13 further comprising a switch configured to energize each of the plurality of first female electrical connectors with electricity received from the power cord.

19. A power module, comprising:

a housing configured to be received into an opening in a furniture piece in an orientation determined by engagement of an external feature of the housing with an internal feature of the furniture piece opening;

a plurality of first female electrical connectors each coupled to an external surface of the housing;

an extension cord stored internal to the housing and configured to:

extend from the housing to a variable length; and self-retract into the housing;

a second female electrical connector coupled to an external end of the extension cord; and a power cord coupled to the housing and configured to energize the second female electrical connector, via the extension cord, and each of the plurality of first female electrical connectors.

20. The power module of claim 19 wherein the external feature of the housing and the internal feature of the furniture piece opening are each selected from the group consisting of:

a ridge;

a slot;

a groove;

a boss;

an elongated projection; and an elongated recess.

* * * * *